US007555246B2

(12) United States Patent
Zirilli

(10) Patent No.: US 7,555,246 B2
(45) Date of Patent: Jun. 30, 2009

(54) DEVELOPMENT SUB-SYSTEM IN-LINE CLEANING SYSTEM

(75) Inventor: Francisco Zirilli, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 438 days.

(21) Appl. No.: 11/455,618

(22) Filed: Jun. 19, 2006

(65) Prior Publication Data

US 2007/0292164 A1 Dec. 20, 2007

(51) Int. Cl.
*G03G 15/08* (2006.01)
*G03G 21/20* (2006.01)
*G03G 15/095* (2006.01)

(52) U.S. Cl. ..... 399/253; 399/93; 399/99; 399/264

(58) Field of Classification Search ..... 399/93, 399/98, 99, 253, 264, 266, 290
See application file for complete search history.

(56) References Cited

U.S. PATENT DOCUMENTS 5,465,619 A 11/1995 Sotack et al.
5,649,271 A 7/1997 Bray et al.
5,697,018 A * 12/1997 Thomas et al. ..... 399/93
6,181,896 B1 * 1/2001 Zirilli et al. ..... 399/98

OTHER PUBLICATIONS

Copending U.S. Appl. No. 11/455,530, filed Jun. 19, 2006, entitled Development Sub-System In-Line Cleaning System, by Francisco Zirilli.

* cited by examiner

*Primary Examiner*—Sandra L Brase
(74) *Attorney, Agent, or Firm*—Lloyd F. Bean, II

(57) ABSTRACT

An electrophotographic printing machine of the type in which an electrostatic latent image recorded on a charge retentive surface is developed with toner particles to form a visible image thereof, including: a housing having a supply of toner and developer therein; a donor member for transporting toner from the housing to a development zone; a first manifold, adjacent to the donor member, having an air stream for removing toner emission; a second manifold, adjacent to the donor member, having an air stream for removing toner emission; and a cyclone separator system, connected to the first manifold and the second manifold, for separating the toner from the air stream and returning toner particles of a predefined size back into the housing.

18 Claims, 3 Drawing Sheets

DEVELOPMENT SUB-SYSTEM IN-LINE CLEANING SYSTEM

CROSS-REFERENCE TO RELATED APPLICATION(S)

Reference is made to commonly-assigned U.S. patent application Ser. No. 11/455,530, now U.S. Pat. No. 7,428,398, filed concurrently herewith, entitled Development Sub-System In-Line Cleaning System, by Francisco Zirilli, the disclosure of which is incorporated herein.

BACKGROUND AND SUMMARY

This invention relates generally to an electrophotographic printing machine, and more particularly use of an in-line cyclone separator to separate the toner from the air stream before it is transported to the final filter assembly.

Generally, the process of electrophotographic printing includes charging a photoconductive member to a substantially uniform potential so as to sensitize the surface thereof. The charged portion of the photoconductive surface is exposed to a light image of an original document being reproduced. This records an electrostatic latent image on the photoconductive member. After the electrostatic latent image is recorded on the photoconductive member, the latent image is developed by bringing a developer material into contact therewith. Two component and single component developer materials are commonly used. A typical two component developer material has magnetic carrier granules with toner particles adhering triboelectrically thereto. A single component developer material typically comprises toner particles. Toner particles are attracted to the latent image forming a toner powder image on the photoconductive member. The toner powder image is subsequently transferred to a copy sheet. Finally, the toner powder image is heated to permanently fuse it to the copy sheet in image configuration.

There is provided an electrophotographic printing machine of the type in which an electrostatic latent image recorded on a charge retentive surface is developed with toner particles to form a visible image thereof, including: a housing having a supply of toner and developer therein; a donor member for transporting toner from the housing to a development zone; a first manifold, adjacent to the donor member, having an air stream for removing toner emission; a second manifold, adjacent to the donor member, having an air stream for removing toner emission; and a cyclone separator system, connected to the first manifold and the second manifold, for separating the toner from the air stream and returning toner particles of a predefined size back into the housing.

BRIEF DESCRIPTION OF THE DRAWINGS

Other features of the present invention will become apparent as the following description proceeds and upon reference to the drawings, in which.

DETAILED DESCRIPTION

While the present invention will be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Inasmuch as the art of electrophotographic printing is well known, the various processing stations employed in the FIG. 1 printing machine will be shown hereinafter schematically and their operation described briefly with reference thereto.

Figure 1:
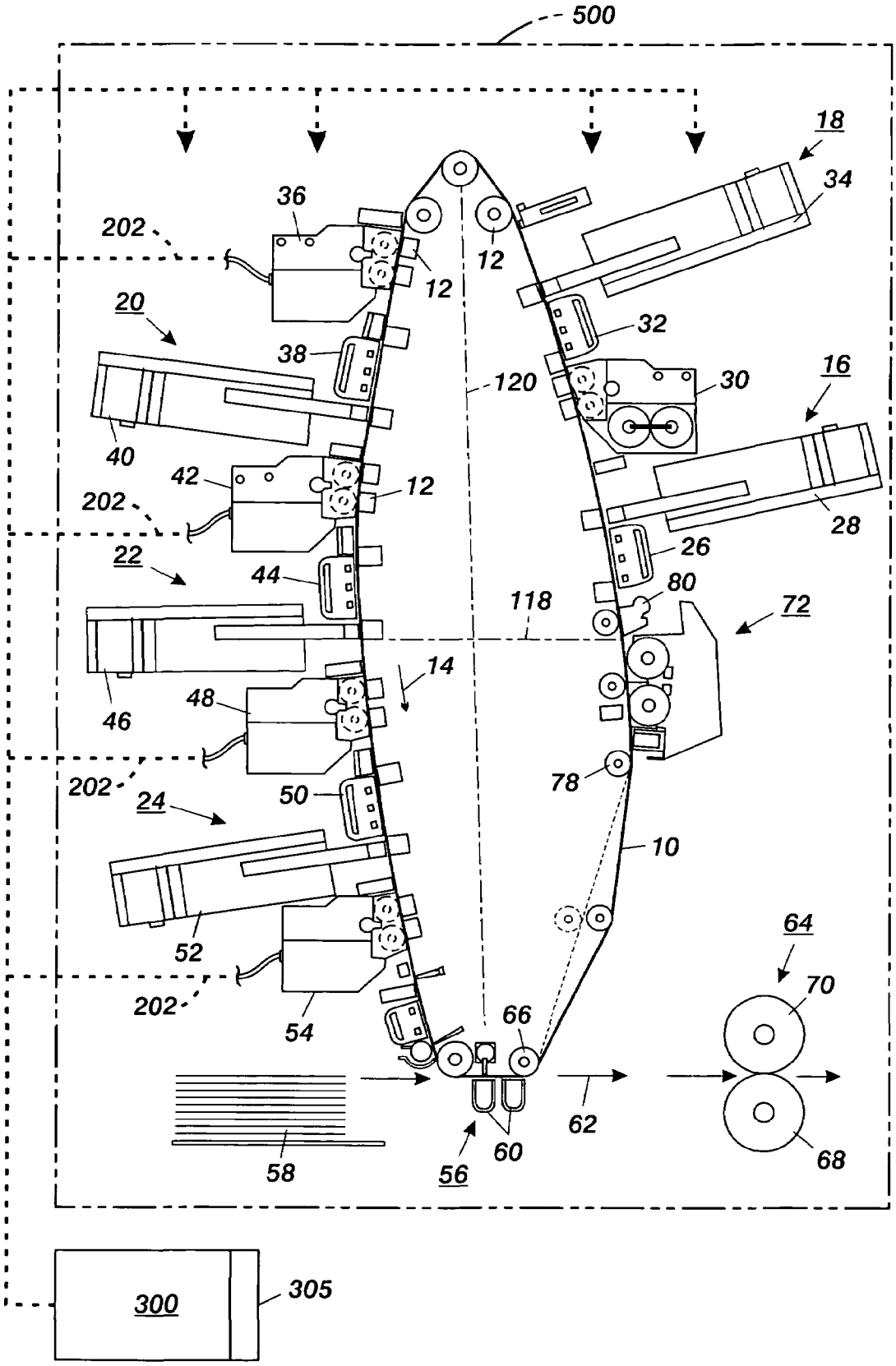
FIG. 1 is a schematic elevational view of an illustrative electrophotographic printing machine.

Referring now to the drawings, there is shown a single pass multi-color printing machine in FIG. 1. This printing machine employs the following components: a photoconductive belt 10, supported by a plurality of rollers or bars, 12. Photoconductive belt 10 is arranged in a vertical orientation. Photoconductive belt 10 advances in the direction of arrow 14 to move successive portions of the external surface of photoconductive belt 10 sequentially beneath the various processing stations disposed about the path of movement thereof. The photoconductive belt 10 has a major axis 120 and a minor axis 118. The major and minor axes 120, 118 are perpendicular to one another. Photoconductive belt 10 is elliptically shaped. The major axis 120 is substantially parallel to the gravitational vector and arranged in a substantially vertical orientation. The minor axis 118 is substantially perpendicular to the gravitational vector and arranged in a substantially horizontal direction. The printing machine architecture includes five image recording stations indicated generally by the reference numerals 16, 18, 20, 22, and 24, respectively. Initially, photoconductive belt 10 passes through image recording station 16. Image recording station 16 includes a charging device and an exposure device. The charging device includes a corona generator 26 that charges the exterior surface of photoconductive belt 10 to a relatively high, substantially uniform potential. After the exterior surface of photoconductive belt 10 is charged, the charged portion thereof advances to the exposure device. The exposure device includes a raster output scanner (ROS) 28, which illuminates the charged portion of the exterior surface of photoconductive belt 10 to record a first electrostatic latent image thereon. Alternatively, a light emitting diode (LED) may be used.

This first electrostatic latent image is developed by developer unit 30. Developer unit 30 deposits toner particles of a selected color on the first electrostatic latent image. After the highlight toner image has been developed on the exterior surface of photoconductive belt 10, photoconductive belt 10 continues to advance in the direction of arrow 14 to image recording station 18.

Image recording station 18 includes a recharging device and an exposure device. The charging device includes a corona generator 32 which recharges the exterior surface of photoconductive belt 10 to a relatively high, substantially uniform potential. The exposure device includes a ROS 34 which illuminates the charged portion of the exterior surface of photoconductive belt 10 selectively to record a second electrostatic latent image thereon. This second electrostatic latent image corresponds to the regions to be developed with magenta toner particles. This second electrostatic latent image is now advanced to the next successive developer unit 36.

Developer unit 36 deposits magenta toner particles on the electrostatic latent image. In this way, a magenta toner powder image is formed on the exterior surface of photoconductive belt 10. After the magenta toner powder image has been developed on the exterior surface of photoconductive belt 10, photoconductive belt 10 continues to advance in the direction of arrow 14 to image recording station 20.

Image recording station 20 includes a charging device and an exposure device. The charging device includes corona generator 38, which recharges the photoconductive surface to a relatively high, substantially uniform potential. The exposure device includes ROS 40 which illuminates the charged portion of the exterior surface of photoconductive belt 10 to selectively dissipate the charge thereon to record a third electrostatic latent image corresponding to the regions to be developed with yellow toner particles. This third electrostatic latent image is now advanced to the next successive developer unit 42.

Developer unit 42 deposits yellow toner particles on the exterior surface of photoconductive belt 10 to form a yellow toner powder image thereon. After the third electrostatic latent image has been developed with yellow toner, photoconductive belt 10 advances in the direction of arrow 14 to the next image recording station 22.

Image recording station 22 includes a charging device and an exposure device. The charging device includes a corona generator 44, which charges the exterior surface of photoconductive belt 10 to a relatively high, substantially uniform potential. The exposure device includes ROS 46, which illuminates the charged portion of the exterior surface of photoconductive belt 10 to selectively dissipate the charge on the exterior surface of photoconductive belt 10 to record a fourth electrostatic latent image for development with cyan toner particles. After the fourth electrostatic latent image is recorded on the exterior surface of photoconductive belt 10, photoconductive belt 10 advances this electrostatic latent image to the cyan developer unit 48.

Developer unit 48 deposits cyan toner particles on the fourth electrostatic latent image. These toner particles may be partially in superimposed registration with the previously formed yellow powder image. After the cyan toner powder image is formed on the exterior surface of photoconductive belt 10, photoconductive belt 10 advances to the next image recording station 24.

Image recording station 24 includes a charging device and an exposure device. The charging device includes corona generator 50 which charges the exterior surface of photoconductive belt 10 to a relatively high, substantially uniform potential. The exposure device includes ROS 52, which illuminates the charged portion of the exterior surface of photoconductive belt 10 to selectively discharge those portions of the charged exterior surface of photoconductive belt 10 which are to be developed with black toner particles. The fifth electrostatic latent image, to be developed with black toner particles, is advanced to black developer unit 54.

At black developer unit 54, black toner particles are deposited on the exterior surface of photoconductive belt 10. These black toner particles form a black toner powder image which may be partially or totally in superimposed registration with the previously formed highlight color, yellow, magenta, and cyan toner powder images. In this way, a multi-color toner powder image is formed on the exterior surface of photoconductive belt 10. Thereafter, photoconductive belt 10 advances the multi-color toner powder image to a transfer station, indicated generally by the reference numeral 56.

All xerographic subsystems are environmentally maintained inside the xerographic cavity. Air from and to the xerographic cavity is conditioned/filtered to predefined set points by using a special design environmental unit.

At transfer station 56, a receiving medium, i.e., paper, is advanced from stack 58 by sheet feeders and guided to transfer station 56. At transfer station 56, a corona generating device 60 sprays ions onto the backside of the paper. This attracts the developed multi-color toner image from the exterior surface of photoconductive belt 10 to the sheet of paper. Stripping assist roller 66 contacts the interior surface of photoconductive belt 10 and provides a sufficiently sharp bend thereat so that the beam strength of the advancing paper is stripped from photoconductive belt 10. A vacuum transport moves the sheet of paper in the direction of arrow 62 to fusing station 64.

Fusing station 64 includes a heated fuser roller 70 and a back-up roller 68. The back-up roller 68 is resiliently urged into engagement with the fuser roller 70 to form a nip through which the sheet of paper passes. In the fusing operation, the toner particles coalesce with one another and bond to the sheet in image configuration, forming a multi-color image thereon. After fusing, the finished sheet is discharged to a finishing station where the sheets are compiled and formed into sets which may be bound to one another. These sets are then advanced to a catch tray for subsequent removal therefrom by the printing machine operator.

One skilled in the art will appreciate that while the multi-color developed image has been disclosed as being transferred to paper, it may be transferred to an intermediate member, such as a belt or drum, and then subsequently transferred and fused to the paper. Furthermore, while toner powder images and toner particles have been disclosed herein, one skilled in the art will appreciate that a liquid developer material employing toner particles in a liquid carrier may also be used.

Invariably, after the multi-color toner powder image has been transferred to the sheet of paper, residual toner particles remain adhering to the exterior surface of photoconductive belt 10. The photoconductive belt 10 moves over isolation roller 78 which isolates the cleaning operation at cleaning station 72. At cleaning station 72, the residual toner particles are removed from photoconductive belt 10. Photoconductive belt 10 then moves under spots blade 80 to also remove toner particles therefrom.

Environmental conditioning unit maintains the printing machine components enclosed in enclosure 500 at a predefined temperature and humidity. The Environmental Unit (EU) is an air conditioning unit with dual air flow discharge to provide cooling, heating and dehumidification to the xerographic enclosure/developer housings of the print engine. The EU provides the Print Engine (PE) precise control of temperature and humidity to assure stability of the PE advanced technologies so as to produce a new industry benchmark in image quality and productivity.

Figure 2:
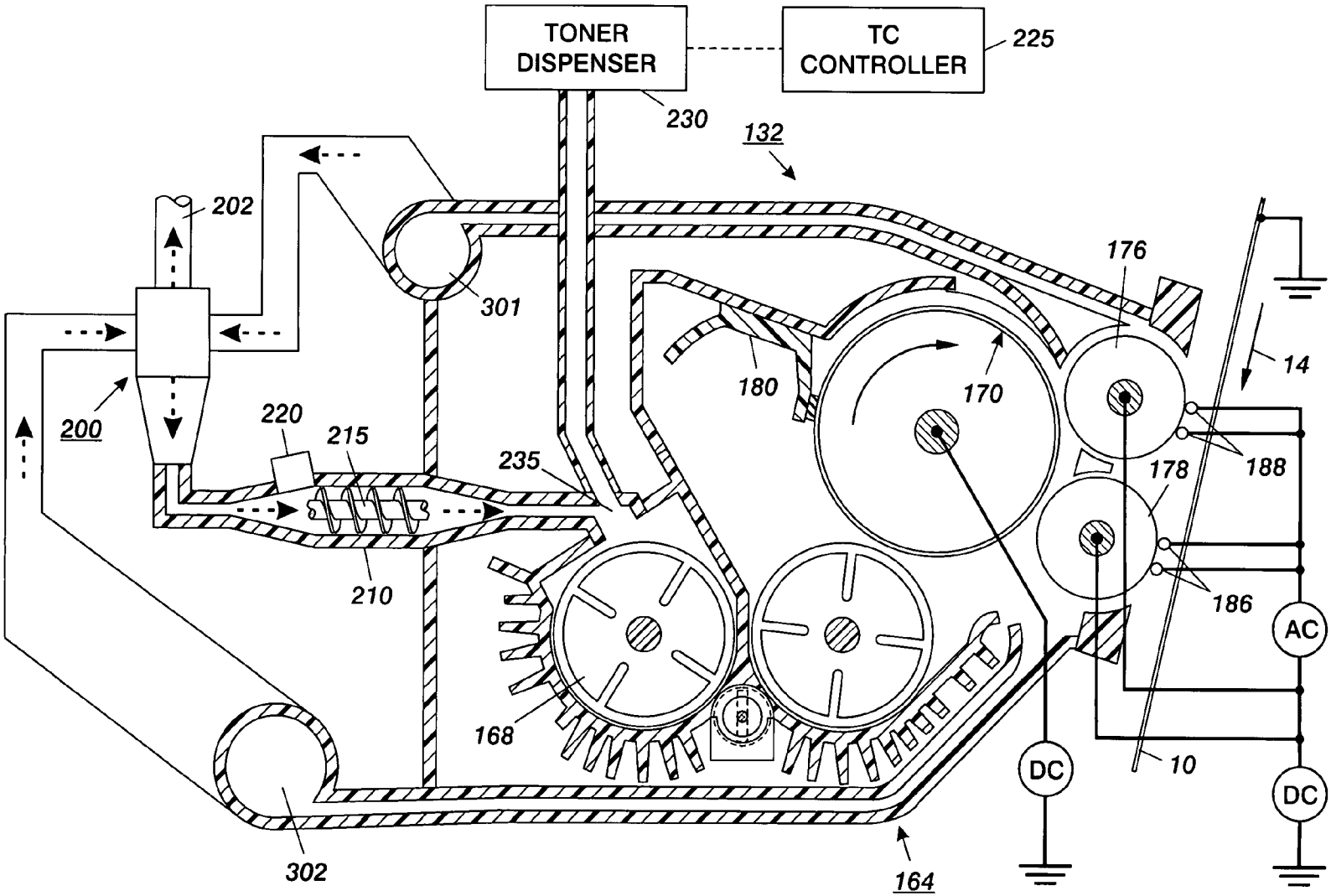
FIG. 2 is a schematic elevational view showing the development apparatus used in the FIG. 1 printing machine.

Referring now to FIG. 2, there is shown the details of a development apparatus 132. The apparatus comprises a reservoir or developing housing 164 containing developer material. The developer material is of the two component type. That is it comprises carrier granules and toner particles. The reservoir 164 includes augers 168, which are rotatably-mounted in the reservoir chamber. The augers 168 serve to transport and to agitate the developer material within the reservoir 164 and encourage the toner particles to adhere triboelectrically to the carrier granules. A magnetic brush roll 170 transports developer material from the reservoir 164 to loading nips of two donor rolls or members 176, 178. Magnetic brush rolls are well known, so the construction of magnetic brush roll 170 need not be described in great detail. Briefly the magnetic brush roll 170 comprises a rotatable tubular housing within which is located a stationary magnetic cylinder having a plurality of magnetic poles impressed around its surface. The carrier granules of the developer material are permeable, as the tubular housing of the magnetic brush roll 170 rotates, the granules (with toner particles adhering triboelectrically thereto) are attracted to the magnetic brush roll 170 and are conveyed to the donor roll loading nips. A trim bar 180 removes excess developer material from the magnetic brush roll 170 and ensures an even depth of coverage with developer material before arrival at the first donor roll loading nip 176. At each of the donor roll loading nips, toner particles are transferred from the magnetic brush roll 170 to the respective donor rolls 176, 178.

Donor rolls 176, 178 transport the toner to a respective development zone through which the photoconductive belt 10 passes. Transfer of toner from the magnetic brush roll 170 to the donor rolls 176, 178 can be encouraged by, for example, the application of a suitable D.C. electrical bias to the magnetic brush roll 170 and/or donor rolls 176, 178. The D.C. electrical bias (for example, approximately 100 V applied to the magnetic brush roll 170) establishes an electrostatic field between the magnetic brush roll 170 and donor rolls 176, 178, which causes toner particles to be attracted to the donor rolls 176, 178 from the carrier granules on the magnetic brush roll 170.

The carrier granules and any toner particles that remain on the magnetic brush roll 170 are returned to the reservoir 164 as the magnetic brush roll 170 continues to rotate. The relative amounts of toner transferred from the magnetic brush roll 170 to the donor rolls 176, 178 can be adjusted, for example by: applying different bias voltages to the donor rolls 176, 178; adjusting the magnetic brush roll to donor roll spacing; adjusting the strength and shape of the magnetic field at the loading nips and/or adjusting the speeds of the donor rolls 176, 178.

At each of the development zones, toner is transferred from the respective donor rolls 176, 178 to the latent image on the photoconductive belt 10 to form a toner powder image on the latter. In FIG. 2, each of the development zones is shown as having the form i.e. electrode wires 186, 188 are disposed in the space between each donor rolls 176, 178 and photoconductive belt 10. FIG. 2 shows, for each donor rolls 176, 178, a respective pair of electrode wires 186, 188 extending in a direction substantially parallel to the longitudinal axis of the donor rolls 176, 178. The electrode wires 186, 188 are made from thin (i.e. 50 to 100 μm diameter) tungsten wires which are closely spaced from the respective donor rolls 176, 178. The distance between each pair of electrode wires 186, 188 and the respective donor rolls 176, 178 is within the range from about 10 μm to about 40 μm (typically approximately 25 μm or the thickness of the toner layer on the donor rolls 176, 178. The electrode wires 186, 188 are self-spaced from the donor rolls 176, 178 by the thickness of the toner on the donor rolls 176, 178. To this end the extremities of the electrode wires 186, 188 are supported by wire module of the present invention. The electrode wires 186, 188 extremities are supported by wire module so that they are slightly below a tangent to the surface, including the toner layer, of the donor rolls 176, 178. An alternating electrical bias is applied to the electrode wires 186, 188 by an AC voltage source.

The applied AC establishes an alternating electrostatic field between each pair of electrode wires 186, 188 and the respective donor rolls 176, 178, which is effective in detaching toner from the surface of the donor rolls 176, 178 and forming a toner cloud about the electrode wires 186, 188, the height of the cloud being such as not to be substantially in contact with the photoconductive belt 10. The magnitude of the AC voltage is relatively low, for example in the order of 200 to 500 volts peak a frequency ranging from about 3 kHz to about 10 kHz. A DC bias supply (not shown) applied to donor rolls 176, 178 establishes electrostatic fields between the photoconductive belt 10 and donor rolls 176, 178 for attracting the detached toner particles from the clouds surrounding the electrode wires 186, 188 to the latent image recorded on the photoconductive surface of the photoconductive belt 10. At a spacing ranging from about 10 μm to about 40 μm between the electrode wires 186, 188 and donor rolls 176, 178, an applied voltage of 200 to 500 volts produces a relatively large electrostatic field without risk of air breakdown.

After development, toner may be stripped from the donor rolls 176, 178 by respective cleaning blades (not shown) so that magnetic brush roll 170 meters fresh toner to clean donor rolls 176, 178. As successive electrostatic latent images are developed, the toner particles within the developer material are depleted.

A toner dispenser 230 stores a supply of toner particles. The toner dispenser is in communication with reservoir 164 and, as the concentration of toner particles in the developer material is decreased, fresh toner particles are furnished to the developer material in the reservoir 164. The augers 168 in the reservoir chamber mix the fresh toner particles with the remaining developer material so that the resultant developer material therein is substantially uniform with the concentration of toner particles being optimized. Toner concentration controller 225 controls toner dispenser 230 so that a substantially constant amount of toner particles is in the reservoir 164 with the toner particles having a constant charge.

In the arrangement shown in FIG. 2, the donor rolls 176, 178 and the magnetic brush roll 170 can be rotated either "with" or "against" the direction of motion of the photoconductive belt 10. The developer housing employs a system to control toner emission which is composed of two manifolds 301 and 302. The two manifolds are placed above and below the upper and lower donor rolls respectively. The manifolds are mounted in a position to improve emissions control as well as reductions in the flow needed to accomplish the task.

Now focusing on embodiment of the present disclosure, while each development apparatus has a cyclone separator system for illustrative purposes the operation of one will be described in detail. As shown in FIG. 2, cyclone separator system is connected to upper manifold 301 and lower manifold 302. Blower 300 (as shown in FIG. 1) is connected to all cyclone separator systems and supplies an air stream to upper manifold 301 and lower manifold 302 for collecting toner emissions. When the air stream having containing airborne toner enters cyclone separator system 200, toner is separated by particle size. Undesirable particle sized toner exits cyclone separator system 200 via port 202 whereupon it is collected in final filter 305 (as shown in FIG. 1). Toner particles of a predefined size are returned back into the housing for reuse.

Applicants have found that reducing the amount of toner flowing through the system will: a) increase final filter life, b) reduce service cost since toner accumulation in the hoses will decrease, and c) increase flow latitude through the system allowing for lower flows and pressure resulting in reduce blower speeds, noise, and cost.

In an embodiment of the present disclosure the cyclone separator system 200 may include a staging area 210 (such as a sump) for collecting toner particles of the predefined size after the air stream with toner emission has been processed by cyclone separator system. A transport system 215, such as augers, transports toner particles of the predefined size from the staging area to the housing. Sensor 220, such as disclosed in U.S. Pat. No. 5,465,619 hereby incorporated by reference, senses the amount of toner particles in the staging area 210 and sends a signal to controller 225. Controller 225 is responsive to a toner add signal from a toner concentration controller 230 and sensor 220, and selectively activates the transport system 215 to transport toner particles of said predefined size from the staging area 210 to the housing. The controller 225 may activate the transport system 215 to transport toner particles from the staging area to a waste container (not shown) via outlet 235 in response to a predefined condition. The predefined condition may be that the staging area is full or toner age exceeded a predefined age.

Figure 3:
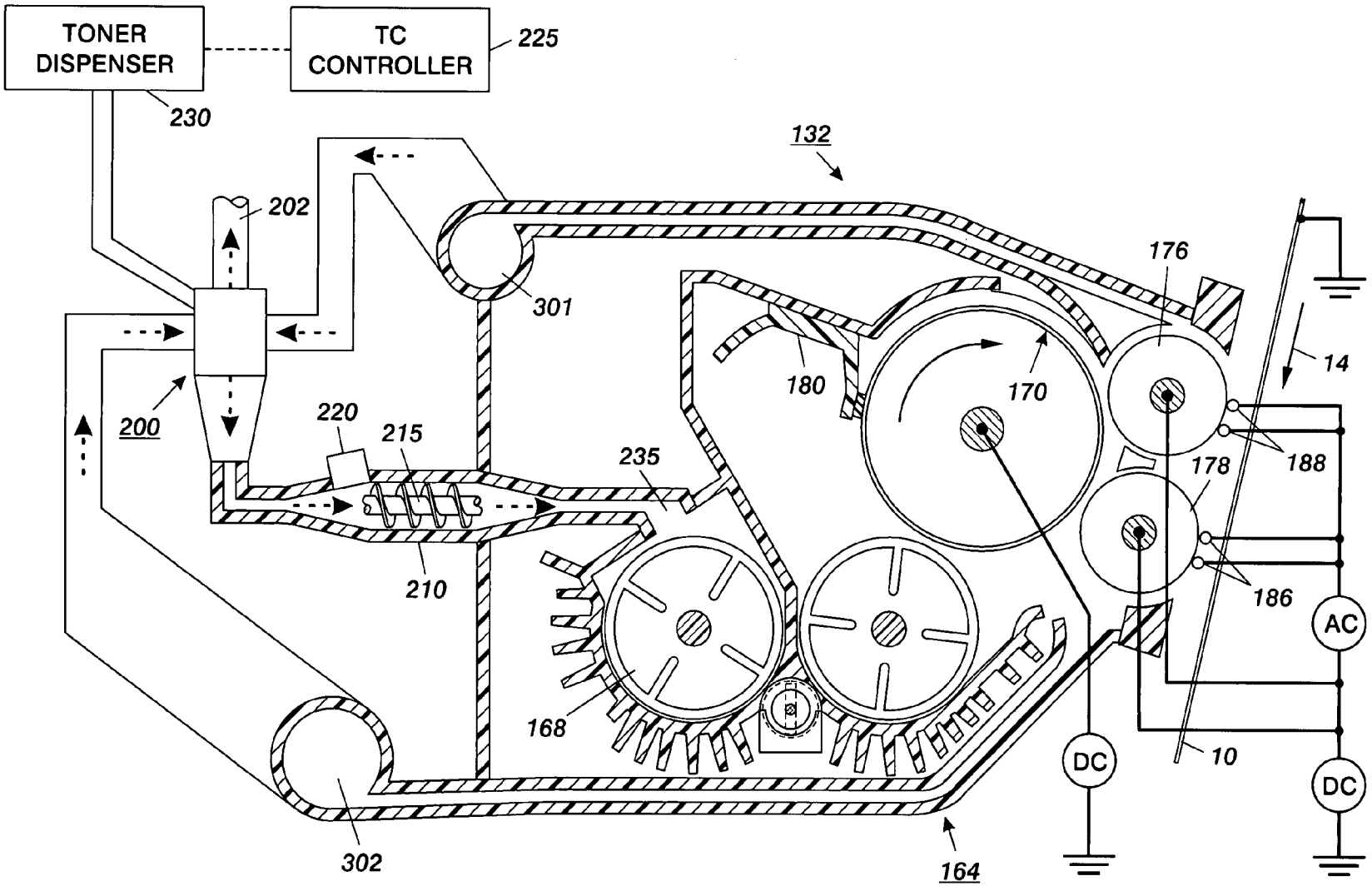
FIG. 3 is a schematic elevational view showing another embodiment of the development apparatus used in the FIG. 1 printing machine.

Another embodiment of the present disclosure is illustrated in FIG. 3. In this embodiment cyclone separator system 200 is also connected to toner dispenser 230. Cyclone separator system 200 separates the fresh toner from toner dispenser 230 into a predefined size into the housing while also separating the used toner from the emission system, wherein the predefined size is between 5 μm and 15 μm.

It is, therefore, apparent that there has been provided in accordance with the present invention a development system that fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations that fall within the spirit and broad scope of the appended claims.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. An electrophotographic printing machine of the type in which an electrostatic latent image recorded on a charge retentive surface is developed with toner particles to form a visible image thereof, comprising: a housing having a supply of toner and developer therein;

a donor member for transporting toner from said housing to a development zone;

a first manifold, adjacent to said donor member, having an air stream for removing toner emission:

a second manifold, adjacent to said donor member, having an air stream for removing toner emission; and a cyclone separator system, connected to said first manifold and said second manifold, for separating the toner from the air stream and returning toner particles of a predefined size back into said housing, said cyclone separator system includes a staging area for collecting toner particles of said predefined size after the air stream with toner emission has been processed.

2. The electrophotographic printing machine of claim 1, wherein said cyclone separator system includes a transport system for transporting toner particles of said predefined size from said staging area to said housing.

3. The electrophotographic printing machine of claim 2, wherein said cyclone separator system includes a controller, responsive to a toner add signal from a toner concentration controller, for activating said transport system to transporting toner particles of said predefined size from said staging area to said housing.

4. The electrophotographic printing machine of claim 3, wherein said controller activates said transport system to transport toner particles of said predefined size from said staging area to a waste container in response to a predefined condition.

5. The electrophotographic printing machine of claim 4, wherein said predefined condition is staging area full.

6. The electrophotographic printing machine of claim 4, wherein said predefined condition is toner age exceeded.

7. The electrophotographic printing machine of claim 1, wherein said cyclone separator system includes sensor for sensing the amount of toner particles in the staging area.

8. The electrophotographic printing machine of claim 1, wherein said donor member includes a first and second donor roll.

9. The electrophotographic printing machine of claim 1, wherein said predefined size is between 5 μm and 15 μm.

10. A developer comprising: a housing having a supply of toner and developer therein:

a donor member for transporting toner from said housing to a development zone;

a first manifold, adjacent to said donor member, having an air stream for removing toner emission;

a second manifold, adjacent to said donor member, having an air stream for removing toner emission; and a cyclone separator system, connected to said first manifold and said second manifold, for separating the toner from the air stream and returning toner particles of a predefined size back into said housing, said cyclone separator system includes a staging area for collecting toner particles of said predefined size after the air stream with toner emission has been processed.

11. The developer of claim 10, wherein said cyclone separator system includes a transport system for transporting toner particles of said predefined size from said staging area to said housing.

12. The developer of claim 11, wherein said cyclone separator system includes a controller, responsive to a toner add signal from a toner concentration controller, for activating said transport system to transporting toner particles of said predefined size from said staging area to said housing.

13. The developer of claim 12, wherein said controller activates said transport system to transport toner particles of said predefined size from said staging area to a waste container in response to a predefined condition.

14. The developer of claim 13, wherein said predefined condition is staging area full.

15. The developer of claim 13, wherein said predefined condition is toner age exceeded.

16. The developer of claim 10, wherein said cyclone separator system includes sensor for sensing the amount of toner particles in the staging area.

17. The developer of claim 10, wherein said donor member includes a first and second donor roll.

18. A developer comprising: a housing having a supply of toner and developer therein;

a donor member for transporting toner from said housing to a development zone;

a first manifold, adjacent to said donor member, having an air stream for removing toner emission;

a second manifold, adjacent to said donor member, having an air stream for removing toner emission; and a cyclone separator system, connected to said first manifold and said second manifold, for separating the toner from the air stream and returning toner particles of a predefined size back into said housing, said predefined size is between 5 μm and 15 μm.

* * * * *